US008182213B2

(12) United States Patent
Cheung

(10) Patent No.: US 8,182,213 B2
(45) Date of Patent: May 22, 2012

(54) VANE ASSEMBLY WITH REMOVABLE VANES

(75) Inventor: Kin-Leung Cheung, Toronto (CA)

(73) Assignee: Pratt & Whitney Canada Corp., Longueuil (CA)

( * ) Notice: Subject to any disclaimer, the term of this patent is extended or adjusted under 35 U.S.C. 154(b) by 527 days.

(21) Appl. No.: 12/407,256

(22) Filed: Apr. 22, 2009

(65) Prior Publication Data

US 2010/0272565 A1 Oct. 28, 2010

(51) Int. Cl.
*F04D 29/44* (2006.01)
*F04D 29/54* (2006.01)

(52) U.S. Cl. ..... 415/200; 415/115; 415/208.2; 416/223 R; 416/241 A

(58) Field of Classification Search ..... 415/200, 415/208.2, 137, 115, 114; 416/223 R, 241 A
See application file for complete search history.

(56) References Cited

U.S. PATENT DOCUMENTS

| | | | | |
|---|---|---|---|---|
| 3,393,436 | A | 7/1968 | Blackhurst et al. | |
| 3,515,501 | A | 6/1970 | Palfreyman et al. | |
| 3,904,316 | A | 9/1975 | Clingman et al. | |
| 3,966,523 | A | 6/1976 | Jakobsen et al. | |
| 4,339,229 | A | 7/1982 | Rossman | |
| 4,470,862 | A | 9/1984 | More et al. | |
| 4,786,347 | A | 11/1988 | Angus | |
| 4,840,536 | A | 6/1989 | Sikorski | |
| 4,877,376 | A | 10/1989 | Sikorski et al. | |
| 5,308,228 | A | 5/1994 | Benoit et al. | |
| 5,342,464 | A | 8/1994 | McIntire et al. | |
| 5,547,342 | A | 8/1996 | Furseth et al. | |
| 5,632,601 | A | 5/1997 | Bodmer et al. | |
| 6,196,794 | B1 | 3/2001 | Matsumoto | |
| 6,578,265 | B2 | 6/2003 | Boshet et al. | |
| 6,821,087 | B2 * | 11/2004 | Matsumoto et al. | 415/191 |
| 6,887,032 | B2 | 5/2005 | Favre-Felix et al. | |

* cited by examiner

*Primary Examiner* — David Nhu
(74) *Attorney, Agent, or Firm* — Norton Rose Canada LLP

(57) ABSTRACT

A vane assembly for a gas turbine engine where each vane is connected to at least one adjacent portion of at least one of the inner and the outer shrouds through a melt-weld connection. The melt-weld connection includes non-metallic heat-meltable material with a metal wire mesh layer trapped therein, the metal wire mesh being heatable to melt the heat-meltable material for formation and breakdown of the melt-weld connection.

20 Claims, 3 Drawing Sheets

VANE ASSEMBLY WITH REMOVABLE VANES

TECHNICAL FIELD

The application relates generally to vane assemblies for gas turbine engine and, more particularly, to such vane assemblies where the vanes are removable therefrom.

BACKGROUND

A known type of vane assemblies for gas turbine engines in which the vanes are removable includes vanes inserted through holes in a casing and retained by a circumferential strap extending around the casing. Such a retention method has uneven vane retention force around the circumference that is undesirable in high thrust engines. In addition, the strap is generally disengaged from the casing when a vane needs to be replaced, thus at the same time disengaging and shifting the remaining vanes out of position.

SUMMARY

In one aspect, there is provided a vane assembly for a gas turbine engine, the assembly including concentric annular inner and outer shrouds with a plurality of vanes extending therebetween, each vane being connected to at least one adjacent portion of at least one of the inner and the outer shrouds through a melt-weld connection, the melt-weld connection including non-metallic heat-meltable material with a metal wire mesh layer trapped therein, the metal wire mesh being heatable to melt the heat-meltable material for formation and breakdown of the melt-weld connection.

In another aspect, there is provided a vane assembly for a gas turbine engine, the assembly comprising an annular inner shroud, an annular outer shroud concentric with the inner shroud, and a plurality of vanes extending between the inner and outer shrouds, each vane including a vane root connected to the outer shroud by a melt-weld connection, the melt-weld connection including a non-metallic heat-meltable material in contact with the vane root and the outer shroud, the melt-weld connection including a metal wire mesh layer trapped in the material.

In another aspect, there is provided a method of assembling a vane assembly of a gas turbine engine, the assembly including concentric annular inner and outer shrouds with a plurality of vanes extending therebetween, the method comprising providing a non-metallic heat-meltable element between each vane and at least one adjacent portion of at least one of the inner and outer shrouds, the element including a metal wire mesh therein, and using the metal wire mesh to heat and melt the element until formation of a melt-weld connection between each said vane and the at least one adjacent portion.

In a further aspect, there is provided a method of removing a vane assembly of a gas turbine engine, the method comprising heating a melt-weld connection between a vane and at least one adjacent portion of at least one of inner and outer shrouds of the vane assembly using wire mesh trapped within the connection, and pulling the vane out of engagement with the at least one adjacent portion when the connection is sufficiently softened.

DESCRIPTION OF THE DRAWINGS

Reference is now made to the accompanying figures in which.

DETAILED DESCRIPTION

Figure 1:
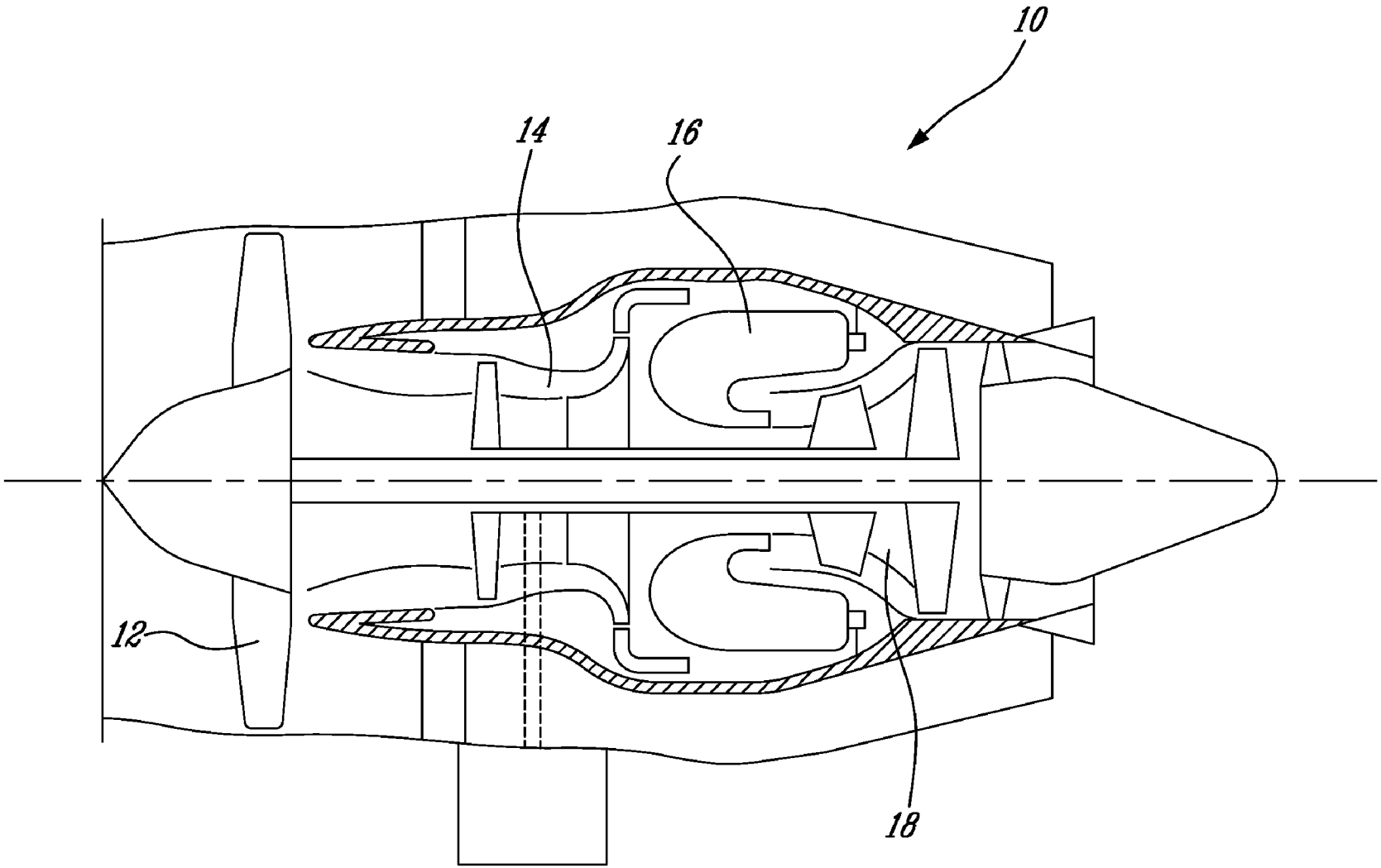
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Figure 2:
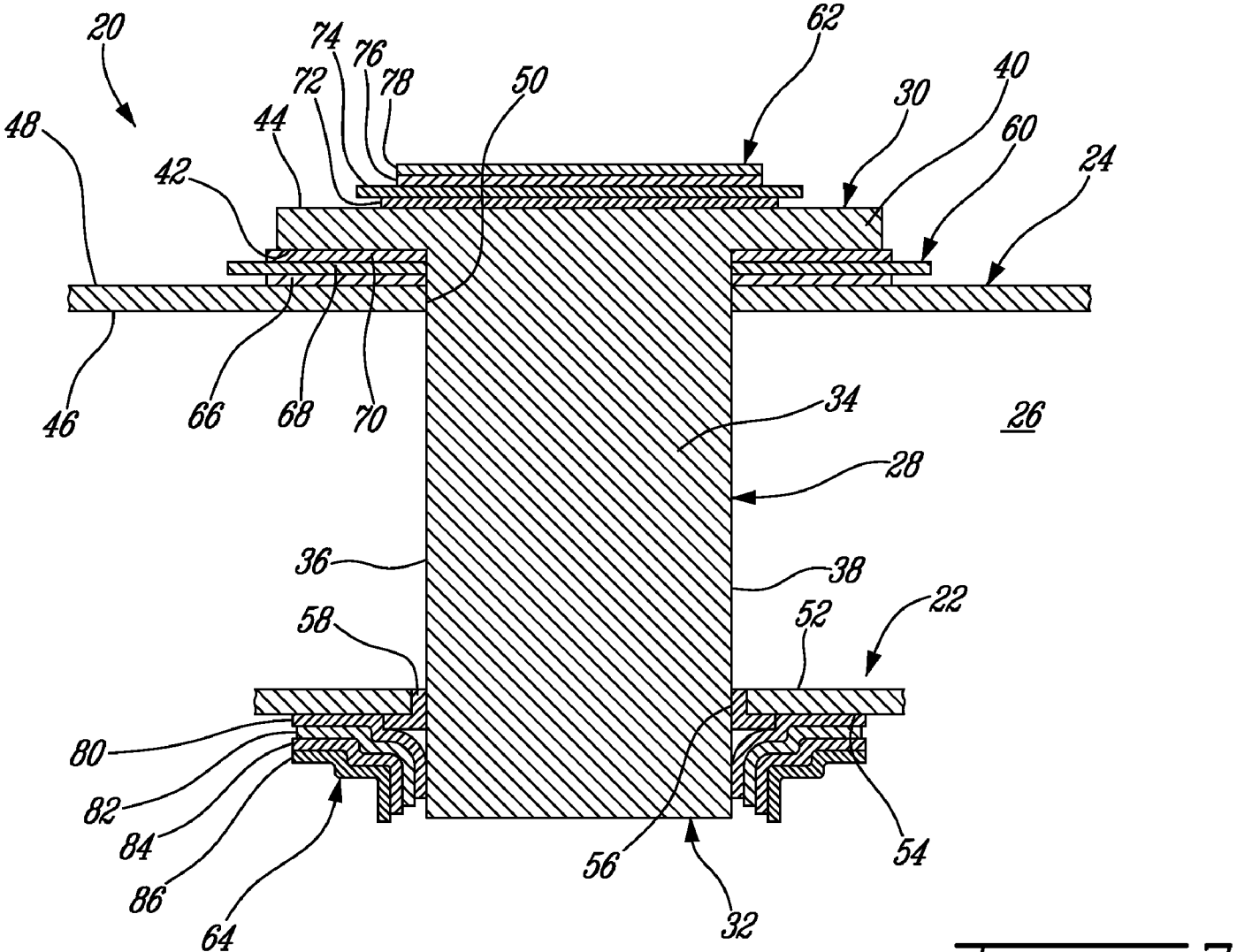
FIG. 2 is a schematic cross-sectional view of part of a vane assembly which can be used in a gas turbine engine such as shown in FIG. 1.

Referring to FIG. 2, a vane assembly 20, which can be for example a part of the fan 12 or a low pressure compressor of the compressor section 14 (both shown in FIG. 1). The vane assembly 20 comprises concentric inner and outer shrouds 22, 24 located downstream of the rotating blades of the rotor (not shown), the inner and outer shrouds 22, 24 defining an annular gas flow path 26 therebetween. The inner and outer shrouds 22, 24 are preferably made of an adequate type of metal, for example an aluminum alloy, titanium alloys or ferrous alloys. In a particular embodiment, the inner and outer shrouds 22, 24 are annular walls spaced from a casing of the engine surrounding the rotor assembly. In an alternate embodiment, the inner and/or outer shrouds 22, 24 correspond to inner and/or outer walls of such a casing.

A plurality of vanes 28 extend radially between the inner and outer shrouds 22, 24 downstream of the rotor blades. The vanes 28 are preferably made of an adequate type of metal, for example an adequate type of aluminum alloy, titanium alloy or ferrous alloy. Each vane 28 has a vane root 30 retained in the outer shroud 24, a vane tip 32 retained in the inner shroud 22, and an airfoil portion 34 extending therebetween. The airfoil portion 34 of each vane 28 defines a leading edge 36 and a trailing edge 38, such that an airflow coming from the blades and passing through the vane assembly 20 flows over the vane airfoil portion 34 from the leading edge 36 to the trailing edge 38.

The vane root 30 comprises an end platform 40 defining an inner pressure surface 42 and an opposed outer surface 44. The outer shroud 24 has an inner surface 46 delimiting the flow path 26 and an outer pressure surface 48 opposite thereto. Vane-receiving openings 50 are defined through the outer shroud 24 and are regularly distributed about the circumference thereof. Each opening 50 has a shape generally corresponding to the shape of the vane 28 radially inwardly of and adjacent to the end platform 40, and is configured such that the vane 28 can be inserted therethrough from the tip 32 while the platform 40 is prevented from passing therethrough.

The inner shroud 22 has an outer surface 52 delimiting the flow path 26 and an inner surface 54 opposite thereto. Vane-receiving openings 56 are defined through the inner shroud 22 and are regularly distributed about the circumference thereof. Each opening 56 is configured such that the tip 32 of the vane 28 can be inserted therethrough and retained with a bonded grommet 58 extending around the tip 32 within the opening 56.

Each vane 28 is connected to adjacent part(s) of the inner and/or the outer shrouds through a melt-weld connection, which is preferably a thermoplastic melt-weld connection. In the embodiment shown, each vane is connected both to the outer shroud 24 and to the inner shroud 22, with the melt-weld connection between each vane 28 and the outer shroud 24 being provided by a melt-weld joint 60 and a melt-weld retainer ring 62, and the melt-weld connection between each vane 28 and the inner shroud 22 being provided by melt-weld brackets 64. Alternately, only one or any two of these connections can be used.

The melt-weld joint 60 is located between, and interconnects, the inner pressure surface 42 of the end platform 40 and the outer pressure surface 48 of the outer shroud 24. In the embodiment shown, the joint 60 includes a first layer 66 of non-metallic heat-meltable material located against the outer surface 48 of the outer shroud 24, a second layer 68 of metal wire mesh, and a third layer 70 of non-metallic heat-meltable material located against the inner pressure surface 42 of the vane platform 40. The heat-meltable material is preferably a thermoplastic material, which may be fiber reinforced. The metal wire mesh of the second layer 68 is used to heat the heat-meltable material, for example through induction heating or resistance hearing, until the material is sufficiently melted to form a connection between the inner and outer pressure surfaces 42, 48. The inner pressure surface 42 and/or the outer pressure surface 48 may include an adequate primer layer to enhance the strength of the bond between the surface and the melt-weld joint 60.

The retainer ring 62 extends over the outer surfaces 44 of the end platforms 40 of the vanes 28, and over portions of the outer shroud 24 extending between adjacent end platforms 40. The end platforms 40 are thus sandwiched between the retainer ring 62 and the outer shroud 24. The retainer ring 62 is made of a continuous film and may include one or several layers of material. In the embodiment shown, the retainer ring 62 includes a first layer 72 of non-metallic heat-meltable material extending over the end platforms 40, a second layer 74 of metal wire mesh over the first layer 72, an optional third layer 76 of fiber or fabric, and a fourth layer 78 of non-metallic heat-meltable material extending over the third layer 76 or over the second layer 74 if the third layer 76 is omitted. The non-metallic heat-meltable material is preferably a thermoplastic material which may be fiber reinforced, such as for example a fiber impregnated thermoplastic film, or which may be in the form of a neat resin thermoplastic film. The fiber or fabric layer 76, including for example dry fiber fabric or dry fiber unidirectional tape, is preferably used in combination with the first layer 72 and/or the fourth layer 78 being made of a neat resin thermoplastic film. The metal wire mesh of the second layer 74 is used to heat the heat-meltable material, for example through induction heating or resistance hearing, until the heat-meltable material is sufficiently melted to form the retainer ring 62. A vacuum bag, heat shrink tape or contact pressure (not shown) may be used to apply pretension to the vane and shroud during formation of the retainer ring 62, and/or shaped dampers may be melt-welded to the retainer ring 62 at the same time to provide vibration damping to the vanes.

The melt-weld brackets 64 extend from each side of the tip 32 to the inner surface 54 of the inner shroud 22. In the embodiment shown, each bracket 64 includes a first layer 80 of non-metallic heat-meltable material extending in contact with the vane tip 32 and the inner surface 54 of the inner shroud, an optional second layer 82 of fiber or fabric extending over the first layer 80, a third layer 84 of metal wire mesh extending over the second layer 82 or over the first layer 80 if the second layer 82 is omitted, and a fourth layer 86 of non-metallic heat-meltable material extending over the third layer 84. The non-metallic heat-meltable material is preferably a thermoplastic material, which may be fiber reinforced or may also be in the form of a neat resin thermoplastic film. The metal wire mesh of the third layer 84 is used to heat the heat-meltable material, for example through induction heating or resistance heating, until the material is sufficiently melted to form the melt-weld connection between the vane tip 32 and the inner shroud 22.

Other heating sources may be used to heat the heat-meltable material of the melt-weld connections (melt-weld joints 60, retainer ring 62 and/or brackets 64) in addition to or in replacement of heating with the metal wire mesh layers 68, 74, 84, such as for example ultrasonic friction melding, or the use of a heat gun, hot air jet and/or a laser.

The melt-weld connection between each vane 28 and the adjacent portion(s) of the inner and/or outer shrouds 22, 24 thus allows the vanes 28 to be removed by heating the melt-weld connections (e.g. the melt-weld joint 60, at least the portion of the retainer ring 62 overlapping the vane 28, the melt-weld brackets 64) between the vane 28 and the adjacent portion(s) of the inner and/or outer shrouds 22, 24, for example using the wire mesh trapped within each melt-weld connection, until the connection is sufficiently softened for the vane to be disengaged from a remainder of the assembly. The wire mesh layer 68, 74, 84 of each connection allows for the heating to be localized around the vane 28 that is to be removed, such as to limit the repair work required once the vane is replaced. In cases where the heat-meltable material is a thermoplastic material that is fiber-reinforced and/or when fiber or fabric layers are present, the fibers preventing the vane from being pulled out are cut prior to removing the vane from the assembly.

A replacement vane can be installed using the above-described method, including providing a heat-meltable element between the vane and each adjacent portion of the inner and/or the outer shroud to which the removed vane was connected, and heating the element, for example through a wire mesh layer embedded therein, until formation of a melt-weld connection such as the melt-weld joint 60, the retainer ring 62 and/or the melt-weld brackets 64. When a retainer ring 62 is present, the cut-out portion of the retainer ring 62 which was removed prior to removing the vane is mended after installation of a new vane by forming a new retainer ring portion over the new vane, for example by overlapping layers of the heat-meltable material, such as a thermoplastic film (with or without fibers), over the cut out portion, and heating until the melt-weld connection of the retainer ring is restored.

As such, installation, refurbishment and replacement of the vanes are facilitated.

Figure 3:
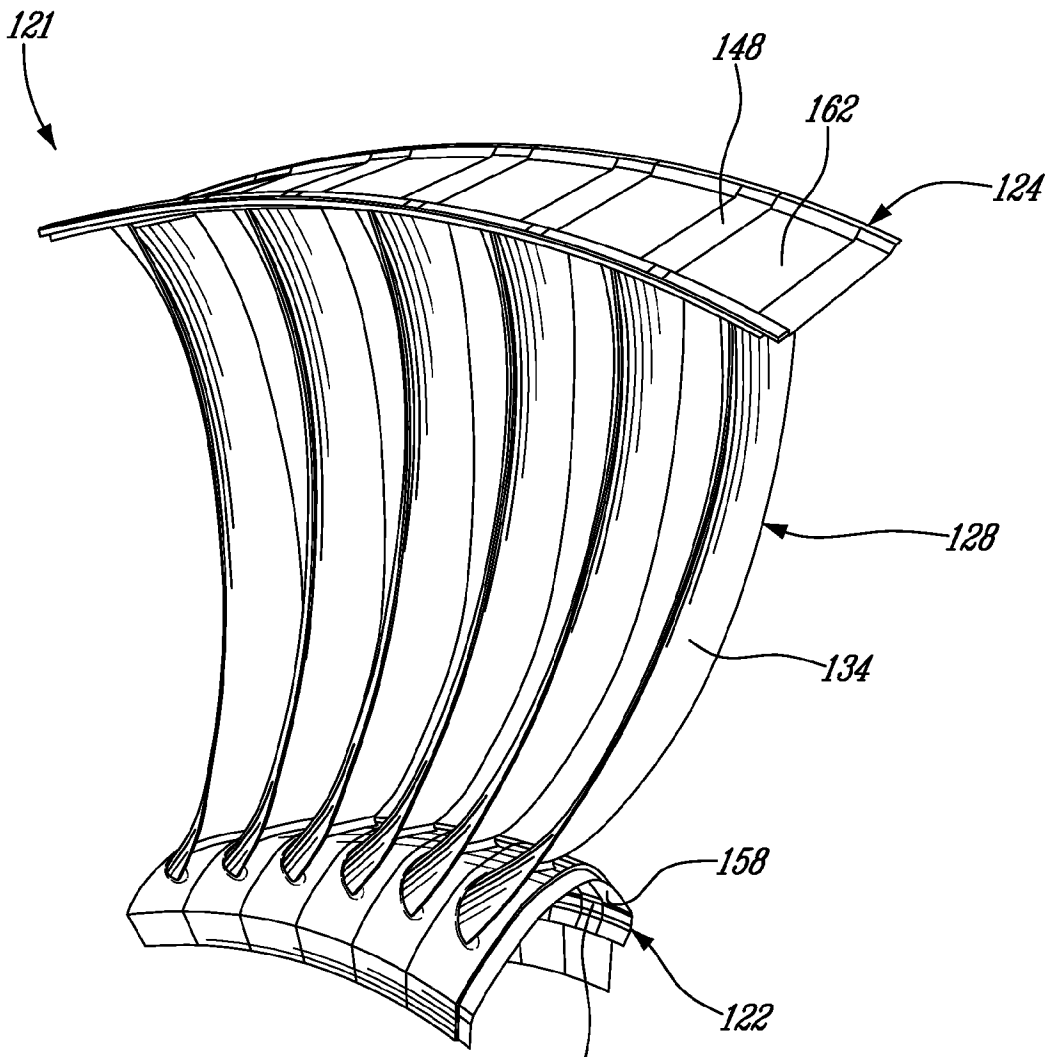
FIG. 3 is a schematic perspective view of a portion of an alternate vane assembly which can be used in a gas turbine engine such as shown in FIG. 1.

Referring to FIG. 3, a vane pack 121 according to an alternate embodiment of the present invention is shown. The tip and root of each vane 128 define corresponding inner shroud and outer shroud portions 122, 124, with the airfoil portion 134 extending therebetween. As such, the inner shroud and the outer shrouds are formed when the vanes are disposed adjacent one another, such that the inner shroud portions 122 defined an annular inner shroud and the outer shroud portions 124 define an annular outer shroud.

The vanes 128 are interconnected such as to define groups or packs 121 of multiple vanes, each pack 121 defining an angular portion of the vane assembly. Each vane 128 within a pack 121 is connected to adjacent portions of the inner and the outer shrouds, which are defined by the inner and outer shroud portions 122, 124 of the adjacent vane(s), through a melt-weld connection. The melt-weld connection between the inner shroud portions 122 of the vanes 128 of a pack 121 is provided by one or more layers 158 of heat-meltable material, for example thermoplastic material which may be fiber reinforced, extending over the inner surface 154 of the inner shroud portions 122. The melt-weld connection between the outer shroud portions 124 of the vanes 128 of a pack 121 is provided by one or more layers 162 of heat-meltable material, for example thermoplastic material which may be fiber reinforced, extending over the outer surface 148 of the outer shroud portions 124. As such, the vanes 128 within a pack 121 are interconnected while allowing for one or more vanes 128 of a pack 121 to be replaced, through heating and softening of the heat-meltable material layers 158, 162 retaining the vane to the adjacent vane(s), as above. A wire mesh layer may be trapped within the heat-meltable material layers 158, 162 to facilitate heating thereof for formation and breakdown of the melt-weld connection.

The vane assembly may be assembled using meld-weld connections between the vane packs 121, for example using a retainer ring as described in the previous embodiment.

A number thermoplastics may be used as the heat-meltable material for forming the melt-weld connection between the outer shroud portions of the vanes, for example polyphenylene sulphide (PPS), polyetheretherketone (PEEK), polyetherketoneketone (PEKK), polyetherimide (PEI), polyamideimide (PAI), polysulfone (PSU) and/or polyphthalamide (PPA).

The above description is meant to be exemplary only, and one skilled in the art will recognize that changes may be made to the embodiments described without departing from the scope of the invention disclosed. For example, the melt-weld connection can be provided in alternate geometries and/or with a different number of layers including a single layer and/or with vanes made of fibre reinforced thermoset polymer materials, or of hybrid metal-fibre reinforced thermoset polymer materials. Still other modifications which fall within the scope of the present invention will be apparent to those skilled in the art, in light of a review of this disclosure, and such modifications are intended to fall within the appended claims.

The invention claimed is:

1. A vane assembly for a gas turbine engine, the assembly including concentric annular inner and outer shrouds with a plurality of vanes extending therebetween, each vane being connected to at least one adjacent portion of at least one of the concentric annular inner and the outer shrouds through a melt-weld connection, the melt-weld connection including non-metallic heat-meltable material with a metal wire mesh layer trapped therein, the metal wire mesh layer being heatable to melt the heat-meltable material for formation and breakdown of the melt-weld connection.

2. The vane assembly as defined in claim 1, wherein the heat-meltable material is a thermoplastic material.

3. The vane assembly as defined in claim 2, wherein the thermoplastic material is fiber-reinforced.

4. The vane assembly as defined in claim 1, wherein each vane includes a vane root received in a respective opening defined through the outer shroud, the outer shroud including an inner surface facing the inner shroud and an opposed outer surface, each vane being connected to the outer shroud with the at least one adjacent portion being defined by the outer surface of the outer shroud adjacent the respective opening, each vane root having an end platform defining an inner pressure surface facing and connected to the outer pressure surface through the melt-weld connection.

5. The vane assembly as defined in claim 1, wherein the melt-weld connection includes a retainer ring including the heat-meltable material with the metal wire mesh layer trapped therein, the retainer ring extending around the outer shroud with a portion of each vane between located between the outer shroud and the retainer ring and in contact with the retainer ring.

6. The vane assembly as defined in claim 1, wherein each vane includes corresponding portions of the inner and outer shrouds with an airfoil portion extending therebetween, such that the inner and outer shrouds are formed respectively by the inner and outer shroud portions of the plurality of vanes disposed adjacent one another, the plurality of vanes being interconnected in at least two distinct groups with the melt-weld connection including at least a first layer of the heat-meltable material extending across the inner shroud portions of adjacent ones of the vanes of a same group and at least a second layer of the heat-meltable material extending across the outer shroud portions of the adjacent ones of the vanes of a same group.

7. The vane assembly as defined in claim 1, wherein each vane includes a vane tip received in a respective opening defined through the inner shroud, the inner shroud including an outer surface facing the outer shroud and an opposed inner surface, each vane being connected to the inner shroud with the at least one adjacent portion being defined by the inner surface of the inner shroud adjacent the respective opening, each vane tip being connected to the inner surface through a bracket defining at least part of the melt-weld connection.

8. A vane assembly for a gas turbine engine, the assembly comprising concentric annular inner and shrouds, and a plurality of vanes extending between the concentric inner and outer shrouds, each vane including a vane root connected to the outer shroud by a melt-weld connection, the melt-weld connection including a non-metallic heat-meltable material in contact with the vane root and the outer shroud, the melt-weld connection including a metal wire mesh layer trapped in the heat-meltable material.

9. The vane assembly as defined in claim 8, wherein the heat-meltable material is a thermoplastic material.

10. The vane assembly as defined in claim 9 wherein the thermoplastic material is fiber-reinforced.

11. The vane assembly as defined in claim 8, wherein each vane root is received in a respective opening defined through the outer shroud and includes an end platform defining an inner pressure surface facing an outer pressure surface of the outer shroud defined adjacent the respective opening, the melt-weld connection interconnecting the inner pressure surface and the outer pressure surface.

12. The vane assembly as defined in claim 8, wherein each vane root is received in a respective opening defined through the outer shroud and includes a root with an end platform adjacent to an outer pressure surface of the outer shroud, the melt-weld connection including a retainer ring overlaying each end platform such that all the end platforms are at least partially contained between the retainer ring and the outer shroud, the retainer ring including the heat-meltable material and the metal wire mesh layer trapped therein.

13. The vane assembly as defined in claim 8, wherein the melt-weld connection is a first melt-weld connection, each vane including a vane tip connected to the inner shroud through a second melt-weld connection including a second non-metallic heat-meltable material in contact with the vane tip and the inner shroud, the second melt-weld connection including a second metal wire mesh layer trapped in the second heat-meltable material.

14. A method of assembling a vane assembly of a gas turbine engine, the vane assembly including concentric annular inner and outer shrouds with a plurality of vanes extending therebetween, the method comprising providing a non-metallic heat-meltable element between each vane and at least one adjacent portion of at least one of the concentric annular inner and outer shrouds, the non-metallic heat-meltable element including a metal wire mesh therein, and using the metal wire mesh to heat and melt the element until formation of a melt-weld connection between each said vane and the at least one adjacent portion.

15. The method as defined in claim 14, further comprising, prior to formation of the melt-weld connection, inserting a tip of each the plurality of vanes through a respective opening defined in the outer shroud, the at least one adjacent portion of at least one of the inner and outer shrouds including an outer surface of the outer shroud defined adjacent the respective opening, and the element is provided between and in contact with the outer surface of the outer shroud and a platform element of each vane.

16. The method as defined in claim 14, wherein the metal wire mesh heats the element through one of resistance heating and induction heating.

17. The method as defined in claim 14, wherein providing the element includes applying at least one layer of thermoplastic material around the outer shroud such as to overlap at least part of a portion of each vane extending from the outer shroud to form a retainer ring therearound.

18. A method of removing a vane assembly of a gas turbine engine, the method comprising heating a melt-weld connection between a vane and at least one adjacent portion of at least one of inner and outer shrouds of the vane assembly using wire mesh trapped within the melt-weld connection, and pulling the vane out of engagement with the at least one adjacent portion when the melt-weld connection is sufficiently softened.

19. The method as described in claim 18, wherein heating the melt-weld connection includes heating a thermoplastic material using the wire mesh, and the vane is pulled when the thermoplastic material is sufficiently softened.

20. The method as described in claim 19, wherein the thermoplastic melt-weld connection is fiber-reinforced, the method further comprising cutting any fiber of the melt-weld connection preventing the vane from being pulled out of engagement with the at least one adjacent portion.

* * * * *